US007046948B1

(12) United States Patent
Zess et al.

(10) Patent No.: US 7,046,948 B1
(45) Date of Patent: May 16, 2006

(54) BRUSH STREAK ERASER

(75) Inventors: Martin F. Zess, Churchville, NY (US); Mark S. Amico, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/067,905

(22) Filed: Mar. 1, 2005

(51) Int. Cl.
*G03G 15/20* (2006.01)

(52) U.S. Cl. ..... 399/325; 219/216; 118/60; 118/101

(58) Field of Classification Search ..... 399/325
See application file for complete search history.

(56) References Cited

U.S. PATENT DOCUMENTS 4,397,936 A * 8/1983 Sakata et al. ..... 118/60
6,091,924 A * 7/2000 Bhattacharya ..... 399/325
6,223,016 B1 4/2001 Jia et al.
6,378,161 B1 4/2002 Parry
6,449,456 B1 * 9/2002 Cahill et al. ..... 399/325
6,829,466 B1 12/2004 Finn et al.
6,838,140 B1 1/2005 Heeks et al.
2002/0028099 A1 * 3/2002 Yamamoto et al. ..... 399/328
2002/0081127 A1 * 6/2002 Hanselman et al. ..... 399/122
2002/0094218 A1 * 7/2002 Fujita et al. ..... 399/325
2004/0101333 A1 * 5/2004 Wu et al. ..... 399/325
2004/0105707 A1 * 6/2004 Schlien ..... 399/325
2005/0123327 A1 * 6/2005 Tateishi et al. ..... 399/325

* cited by examiner

*Primary Examiner*—Arthur T. Grimley
*Assistant Examiner*—Ryan D. Walsh
(74) *Attorney, Agent, or Firm*—Oliff & Berridge, PLC

(57) ABSTRACT

An image formation apparatus that has a fuser roll/belt in pressure contact with a pressure roll that forms a nip, a meter roll that receives a release agent, a donor roll in press contact with the meter roll and is disposed between the meter roll and the fuser roll/belt to transport the release agent from the meter roll to the fuser roll/belt, a metering blade disposed adjacent to the meter roll that regulates an amount of release agent on the surface of the meter roll, and a smoothing/camouflaging device in contact with a surface of one or more of the fuser roll/belt, the meter roll and the donor roll, that smoothes/camouflages a non-uniform application of the release agent.

18 Claims, 4 Drawing Sheets

FIG. 2A
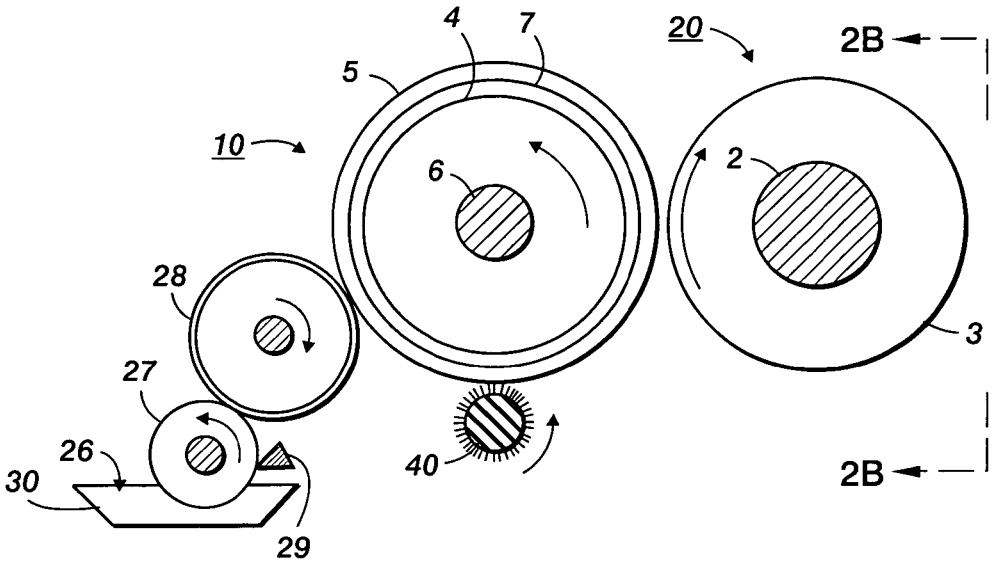
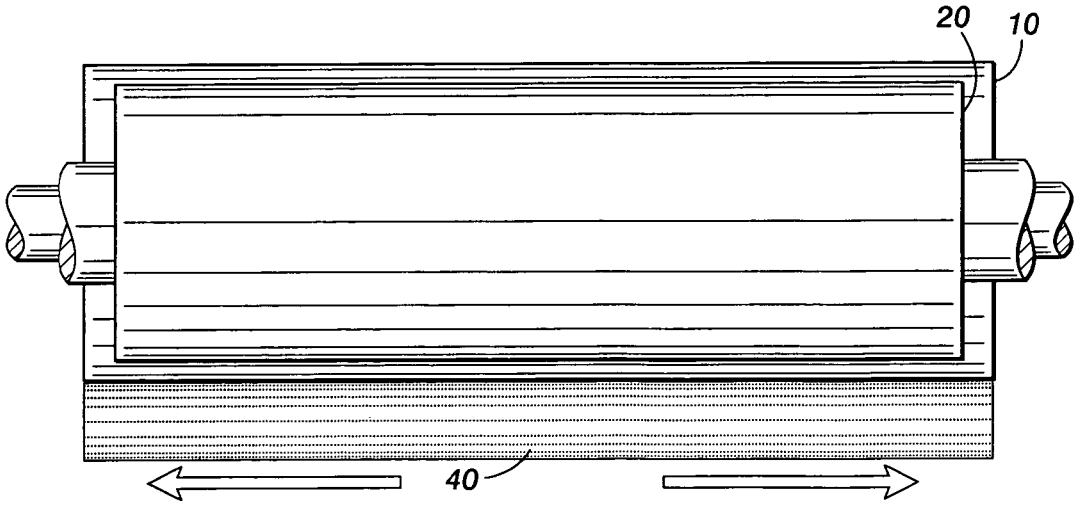
FIG. 2B

FIG. 3A
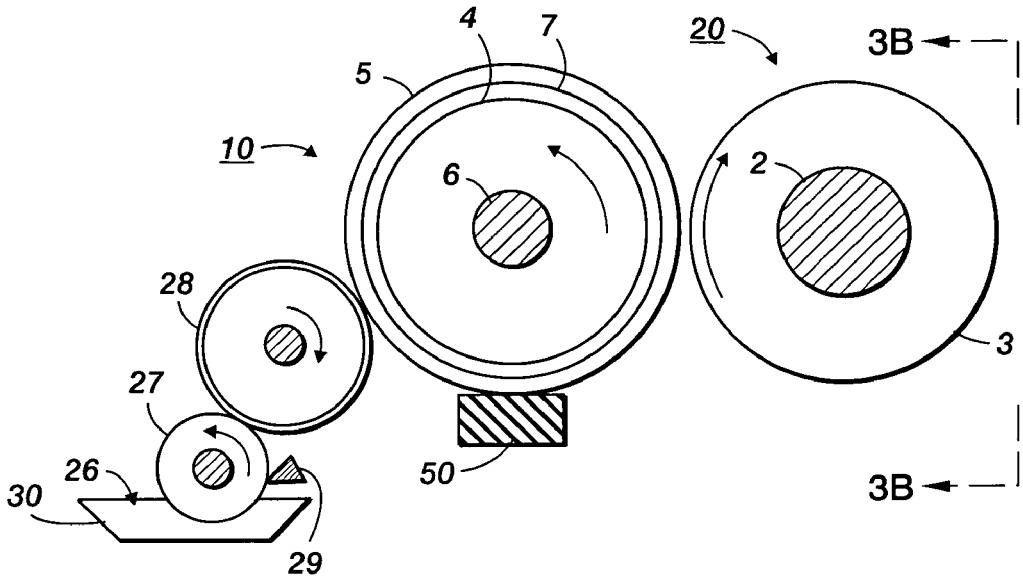
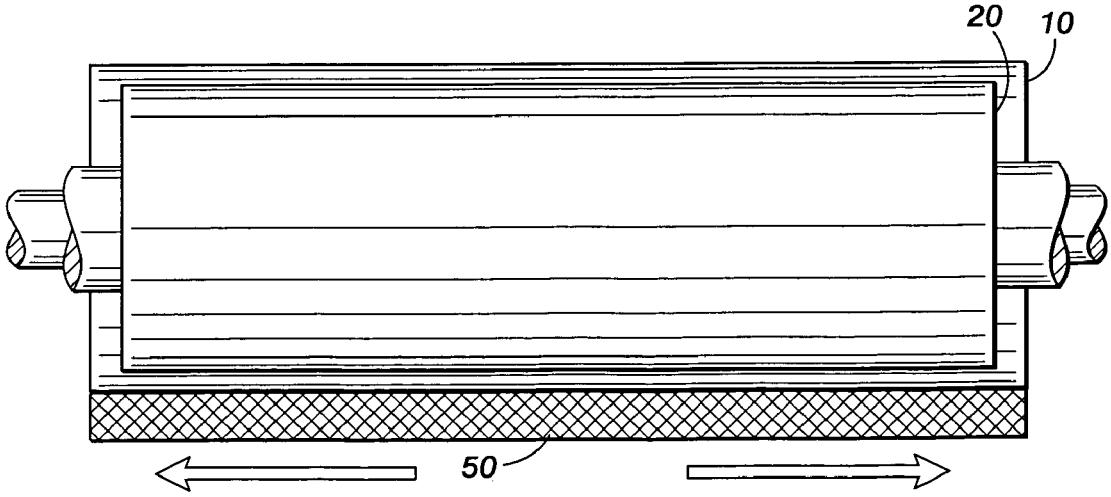
FIG. 3B

FIG. 4
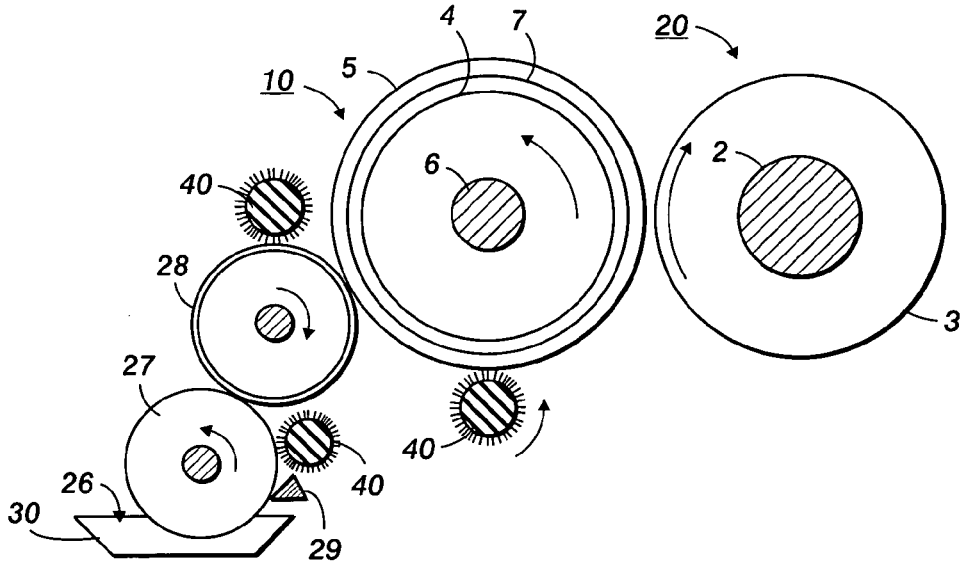
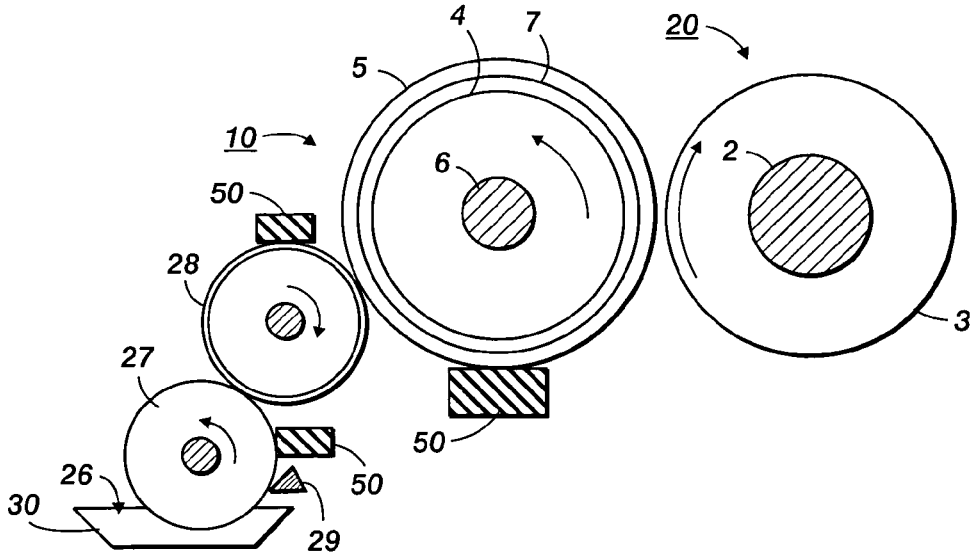
FIG. 5

BRUSH STREAK ERASER

BACKGROUND

The present invention relates generally to an imaging forming apparatus, such as a xerographic system and fuser components for use in electrostatographic, including digital, contact electrostatic printing, and like apparatuses. More specifically, the present invention relates to reducing the effect of fuser oil or release agent streaks on fuser components by smoothing/camouflaging the streaks.

In a typical electrostatographic reproducing apparatus, a light image of an original to be copied is recorded in the form of an electrostatic latent image on a photosensitive member and the latent image is subsequently rendered visible by the application of electroscopic thermoplastic resin particles, which are commonly referred to as toner. The visible toner image is then in a loose powdered form and can be easily disturbed or destroyed. The toner image is usually fixed or fused upon a support, which may be the photosensitive member, or other support sheet, such as plain paper.

Thermal energy is used for fixing the toner image onto the support sheet and includes applying heat and pressure by various means, a roll pair maintained in pressure contact, a belt member in pressure contact with a roll, a belt member in pressure contact with a heater, and the like. Heat may be applied by heating one or both of the rolls, plate members, or belt members. With a fixing apparatus using a thin film in pressure contact with a heater, the electric power consumption is small, and the warming-up period is significantly reduced or eliminated.

It is important in the fusing process that minimal or no offset of the toner particles from the support to the fuser member take place during normal operations. Toner particles offset onto the fuser member may subsequently transfer to other parts of the machine or onto the support in subsequent copying cycles, thus increasing the background or interfering with the material being copied there. Such "hot offset" occurs when the temperature of the toner is increased to a point where the toner particles liquefy and the molten toner splits during the fusing operation with a portion of the toner remaining on the fuser member. The hot offset temperature or degradation of the hot offset temperature is a measure of the release property of the fuser. Accordingly, it is desirable to provide a fusing surface, which has a low surface energy to provide the necessary release. To ensure and maintain good release properties of the fuser, it has become customary to apply release agents, sometimes referred to as fuser oil, to the fuser roll during the fusing operation. Typically, these materials are applied as thin films of, for example, silicone oils to prevent toner offset.

As shown in FIG. 1, a fusing station 1 of an imaging apparatus includes a fuser roll 10 comprising a polymer surface 5 upon a suitable base member 4, a hollow cylinder or core fabricated from any suitable metal, such as aluminum, anodized aluminum, steel, nickel, copper, and the like, having a suitable heating element 6 disposed in the hollow portion thereof which is coextensive with the cylinder. The fuser roll 10 can include an adhesive, cushion, or other suitable layer 7 positioned between the core 4 and the outer layer 5. A pressure roll 20 cooperates with the fuser roll 10 to form a nip 11 through which copy paper or other substrates 8 pass such that toner images 9 contact an elastomer surface of the outer layer 5 of the fuser roll 10. The pressure roll 20 has a rigid steel core 2 with a polymer or elastomer surface or layer 3 thereon. A sump 30 contains a polymeric release agent, or fuser oil, 26 that may be a solid or liquid at room temperature, but it is a fluid at operating temperatures. The pressure roll 20 may include a heating element (not shown).

In the device shown in FIG. 1 for applying the polymeric release agent 26 to the elastomer surface of the outer layer 5, a release agent meter roll 27 and a donor roll 28 are rotatably mounted in the directions indicated by the arrows, are provided to transport the release agent 26 to the elastomer surface 5. The meter roll 27 is partly immersed in the sump 30 and transports on its surface the release agent from the sump 30 to the donor roll 28. By using a metering, or doctor blade 29, a layer of polymeric release fluid 26 can be applied initially to the meter roll 27 and ultimately to the elastomer surface 5 in controlled thicknesses ranging from sub-micrometer thickness to thicknesses of several micrometers of release fluid. The metering blade 29 can regulate the amount of release fluid 26 to be applied to the surface elastomer 5.

However, in such fusing systems if there is debris on the meter roll or the donor roll, or if there is a cut in the doctor blade, then the application of the release agent to the fusing roll can be applied unevenly which would reduce the print quality of the document.

SUMMARY

The subject matter of this application addresses the deleterious effects of fuser oil, or release agent, application defects resulting from debris on the metering roll or from an imperfection in the doctor blade by utilizing a smoothing/camouflaging device, in running contact with the fuser roll surface prior to the fusing nip, to smooth the layer of fuser oil or release agent. IQ Defects caused by fuser oil streaks are particularly noticeable with higher glossing toners. By smoothing/camouflaging the streaks, the deleterious effects on the resulting image are reduced. The smoothing/camouflaging device surface may be of a brush style, roller style, or other style comprised of suitable high temperature materials. The smoothing/camouflaging device may also be rotated and/or oscillated relative to the fuser roll surface.

The smoothing/camouflaging device is placed rotationally between a point on a meter roll and contacting the fusing roll just prior to the nip entry point. Oscillations, as well as rotation of the smoothing/camouflaging device, levels or blurs a non-uniform application of the fusing agent on the surface of the fusing roll, thereby providing a more apparent uniform coverage of the fusing agent on the fusing roll. Additional, or optional, smoothing/camouflaging devices, such as brushes or rollers, may be placed on the metering roll or the donor roll to enhance the efficiency of the agent leveling and/or debris cleaning.

BRIEF DESCRIPTION OF THE DRAWINGS

Various exemplary embodiments of the systems and methods according to the invention will be described in detail, with reference to the following figures, wherein:

FIG. 2*a* shows a fusing system including an exemplary embodiment of the smoothing device of this application as a roller;

FIG. 2*b* shows a side of a fusing system as shown in FIG. 2*a;*

FIG. 3*a* shows a fusing system including an exemplary embodiment of the smoothing device of this application as a brush;

FIG. 3*b* shows a side of a fusing system as shown in FIG. 3*a;*

FIG. 4 shows a fusing system including an exemplary embodiment of the smoothing device of this application having multiple rollers; and FIG. 5 shows a fusing system including an exemplary embodiment of the smoothing device of this application having multiple brushes.

DETAILED DESCRIPTION OF EMBODIMENTS

Figure 1:
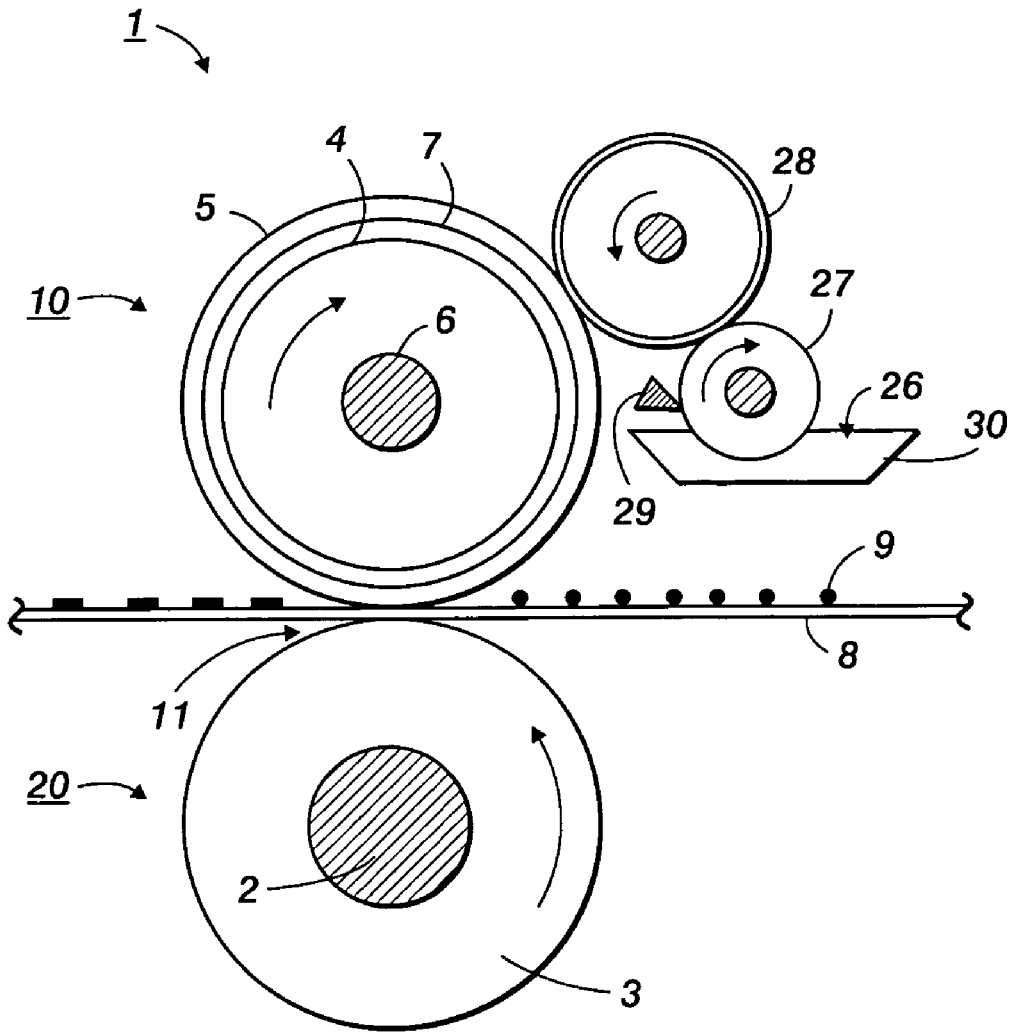
FIG. 1 PRIOR ART
FIG. 1 shows a fusing system.

FIGS. 2 and 3 show a fusing system including exemplary embodiments of the smoothing device of this application.

As shown in FIG. 2, a fusing system has a fuser roll 10 that has an elastomer or a polymer surface outer layer 5 disposed on a base member 4. The base member 4 has a hollow cylinder or core fabricated from any suitable metal, such as aluminum, anodized aluminum, steel, nickel, copper, and the like. A heating element 6 may be disposed in the hollow portion of the core or cylinder of the base member 4. The fuser roll 10 also includes an adhesive, cushion, or other suitable layer 7 positioned between the core 4 and the outer layer 5. A pressure roll 20 cooperates with the fuser roll 10 to form a nip at a contact point between the elastomer surface of the outer layer 5 of the fuser roll 10 and the pressure roll 20 through which copy paper or other substrates (not shown) pass such that toner images are formed on the paper. The pressure roll 20 has a rigid steel core 2 with a polymer or elastomer surface or layer 3 thereon.

A supply wick 30 contains a polymeric release agent, or fuser oil, 26 that may be a solid or liquid at room temperature, but it is a fluid at operating temperatures. The pressure roll 20 may also include a heating element (not shown).

In the device shown in FIG. 2, the supply wick 30 supplies the polymeric release agent or oil 26 to the surface of the meter roll 27 thereby coating the meter roll 27 with the release agent or oil 26. A donor roll 28 is in pressure contact with the meter roll 27 to transport the release agent or oil 26 to the elastomer surface 5 of the fuser roll 10. The meter roll 27 and the donor roll 28 are rotatably mounted in the directions indicated by the arrows. A metering, or doctor blade 29 is provided to regulate an amount of release agent or oil 26 coating the meter roll 27. The doctor blade 29 regulates the amount of release agent or oil 26 by controlling a thickness layer of the release agent or oil 26 that is initially applied to the meter roll 27 and ultimately to the elastomer surface 5.

A smoothing/camouflaging device, such as a roller 40 is disposed in contact with a surface of the fuser roll 10. In an exemplary embodiment, the roller 40 is comprised of a high temperature fiber-like material with a low nap surface that would smooth/camouflage any imperfections in the coverage of the release agent or oil 26 that is on the fuser roll 10. Additionally, the roller 40 will reduce and/or remove the amount of debris on the fuser roll 10 that may be entrapped in the release agent or oil 26.

In an exemplary embodiment, the roller 40 could be a consumable item that would be replaced during maintenance of the fusing system and/or the image forming apparatus. In the embodiment, an assembly (not shown) holds the roller 40 in contact with the fuser roll 10 and allows the roller 40 to rotate clockwise or counterclockwise to the direction of the rotation of the fuser roll 10 and/or oscillate perpendicular to the rotation of the fuser roll 10 (FIG. 2*b*). The roller 40 is in contact with the fuser roll 10 so that the surface of the roller 40 can smooth/camouflage the fuser oil or agent without removing an appreciable amount from the surface of the fuser roll 10. The assembly may be a permanent part of the fusing system or may be replaceable with the roller 40.

In an exemplary embodiment, the roller 40 may oscillate to ensure the entire surface of the fuser roll 10 is contacted by the roller 40 in a non-uniform pattern thereby smoothing/camouflaging a non-uniform application of the release agent or oil 26 due to imperfections in the doctor blade 29 and/or debris entrapped in the release agent or oil 26. In an embodiment, an amount of travel for a typical oscillation would be, but is not restricted to, an order of 2 to 10 mm with a fixed or variable rate of rotation.

As shown in FIG. 3, the fusing system has a fuser roll 10 that has an elastomer or a polymer surface outer layer 5 disposed on a base member 4. The base member 4 has a hollow cylinder or core fabricated from any suitable metal, such as aluminum, anodized aluminum, steel, nickel, copper, and the like. A heating element 6 may be disposed in the hollow portion of the core or cylinder of the base member 4. The fuser roll 10 also includes an adhesive, cushion, or other suitable layer 7 positioned between the core 4 and the outer layer 5. A pressure roll 20 cooperates with the fuser roll 10 to form a nip at a contact point between the elastomer surface of the outer layer 5 of the fuser roll 10 and the pressure roll 20 through which copy paper or other substrates (not shown) pass such that toner images are formed on the paper. The pressure roll 20 has a rigid steel core 2 with a polymer or elastomer surface or layer 3 thereon.

A supply wick 30 contains a polymeric release agent, or fuser oil, 26 that may be a solid or liquid at room temperature, but it is a fluid at operating temperatures. The pressure roll 20 may also include a heating element (not shown).

In the device shown in FIG. 3, the supply wick 30 supplies the polymeric release agent or oil 26 to the surface of the meter roll 27 thereby coating the meter roll 27 with the release agent or oil 26. A donor roll 28 is in press contact with the meter roll 27 to transport the release agent or oil 26 to the elastomer surface 5 of the fuser roll 10. The meter roll 27 and the donor roll 28 are rotatably mounted in the directions indicated by the arrows. A metering, or doctor blade 29 is provided to regulate an amount of release agent or oil 26 coating the meter roll 27. The doctor blade 29 regulates the amount of release agent or oil 26 by controlling a thickness layer of the release agent or oil 26 that is initially applied to the meter roll 27 and ultimately to the elastomer surface 5.

A smoothing/camouflaging device, such as a brush 50 is disposed in contact with a surface of the fuser roll 10. In an exemplary embodiment, the brush 50 is comprised of a high temperature porous fiber-like material with a low nap surface that would smooth any imperfections in the coverage of the release agent or oil 26 that is on the fuser roll 10. Additionally, the brush 50 will reduce and/or remove an amount of debris on the fuser roll 10 that may be entrapped in the release agent or oil 26.

In an exemplary embodiment, the brush 50 could be a consumable item that would be replaced during maintenance of the fusing system and/or the image forming apparatus. In the embodiment, an assembly (not shown) holds the brush 50 in contact with the fuser roll and/or oscillates perpendicular to the rotation of the fuser roll 10 (FIG. 3*b*). The brush 50 is in contact with the fuser roll 10 so that the surface of the brush 50 can smooth/camouflage the fuser oil or agent application effects without removing an appreciable amount from the fuser roll 10. The assembly may be a permanent part of the fusing system or may be replaceable with the brush 50.

In an exemplary embodiment, the brush 50 may oscillate to ensure the brush 50 contacts the fuser roll 10 in a non-uniform pattern thereby smoothing/camouflaging the release agent or oil 26 due to imperfections in the doctor blade 29 and/or debris entrapped in the release agent or oil 26 contacts the entire surface of the fuser roll 10. In an embodiment, an amount of travel for a typical oscillation would be, but is not restricted to, an order of 2 to 10 mm with a fixed or variable rate of rotation.

An example of where the roller 40 or the brush 50 might be located is provided in FIGS. 2 and 3, however, the location is not limited to that shown in FIGS. 2 and 3. Rather the placement of the roller 40 or the brush 50 may be at any point of contact on the fuser roll 10. Furthermore, additional, or optional rollers 40 or brushes 50 may be placed on the meter roll 27 and/or the donor roll 28 to enhance the efficiency and effectiveness of the leveling of the release agent or oil 26 on the fuser roll 10.

FIGS. 4 and 5 show a fusing system including exemplary embodiments of the smoothing/camouflaging device of this application having multiple rollers and brushes, respectively.

As shown in FIG. 4, the fusing system has a fuser roll 10 that has an elastomer or a polymer surface outer layer 5 disposed on a base member 4. The base member 4 has a hollow cylinder or core fabricated from any suitable metal, such as aluminum, anodized aluminum, steel, nickel, copper, and the like. A heating element 6 may be disposed in the hollow portion of the core or cylinder of the base member 4. The fuser roll 10 also includes an adhesive, cushion, or other suitable layer 7 positioned between the core 4 and the outer layer 5. A pressure roll 20 cooperates with the fuser roll 10 to form a nip at a contact point between the elastomer surface of the outer layer 5 of the fuser roll 10 and the pressure roll 20 through which copy paper or other substrates (not shown) pass such that toner images are formed on the paper. The pressure roll 20 has a rigid steel core 2 with a polymer or elastomer surface or layer 3 thereon.

A supply wick 30 contains a polymeric release agent, or fuser oil, 26 that may be a solid or liquid at room temperature, but it is a fluid at operating temperatures. The pressure roll 20 may also include a heating element (not shown).

In the device shown in FIG. 4, the supply wick 30 supplies the polymeric release agent or oil 26 to the surface of the meter roll 27 thereby coating the meter roll 27 with the release agent or oil 26. A donor roll 28 is in press contact with the meter roll 27 to transport the release agent or oil 26 to the elastomer surface 5 of the fuser roll 10. The meter roll 27 and the donor roll 28 are rotatably mounted in the directions indicated by the arrows. A metering, or doctor blade 29 is provided to regulate an amount of release agent or oil 26 coating the meter roll 27. The doctor blade 29 regulates the amount of release agent or oil 26 by controlling a thickness layer of the release agent or oil 26 that is initially applied to the meter roll 27 and ultimately to the elastomer surface 5.

Multiple smoothing/camouflaging devices, such as rollers 40 are disposed in contact with a surface of each of the meter roll 27, the donor roll 28 and the fuser roll 10. In an exemplary embodiment, the rollers 40 are comprised of a high temperature fiber-like material with a low nap surface that would smooth/camouflage any imperfections in the coverage of the release agent or oil 26 that is on each of the meter roll 27, the donor roll 28 and the fuser roll 10. Additionally, the rollers 40 will reduce and/or remove the amount of debris on each of the meter roll 27, the donor roll 28 and the fuser roll 10 that may be entrapped in the release agent or oil 26.

In an exemplary embodiment, the rollers 40 could be a consumable item that would be replaced during maintenance of fusing system and/or the image forming apparatus. In the embodiment, an assembly (not shown) holds the roller 40 in contact with the fuser roll 10 and allows the roller 40 to rotate clockwise or counterclockwise to the direction of the rotation of the fuser roll 10 and/or oscillate perpendicular to the rotation of the fuser roll 10 (see FIG. 2*b*). The roller 40 is in contact with the fuser roll 10 so that the surface of the roller 40 can smooth/camouflage the fuser oil or agent without removing an appreciable amount from the surface of the fuser roll 10. Other brackets hold the additional rollers 40 in contact placement with, but not exclusive to, the donor roll 28 and/or the metering roll 27 in the completed assembly. The additional rollers 40 may be a permanent part of the fusing system or may be replaceable with the original roller 40 on the fusing roll.

In an exemplary embodiment, one or more of the rollers 40 oscillates to ensure the entire surface of the respective meter roll 27, donor roll 28 and fuser roll 10 is contacted by the respective roller 40 thereby smoothing/camouflaging a non-uniform application of the release agent or oil 26 due to imperfections in the doctor blade 29 and/or debris entrapped in the release agent or oil 26. In an embodiment, an amount of travel for a typical oscillation would be, but is not restricted to, an order of 2 to 10 mm with a fixed or variable rate of rotation.

As shown in FIG. 5, the fusing system has a fuser roll 10 that has an elastomer or a polymer surface outer layer 5 disposed on a base member 4. The base member 4 has a hollow cylinder or core fabricated from any suitable metal, such as aluminum, anodized aluminum, steel, nickel, copper, and the like. A heating element 6 may be disposed in the hollow portion of the core or cylinder of the base member 4. The fuser roll 10 also includes an adhesive, cushion, or other suitable layer 7 positioned between the core 4 and the outer layer 5. A pressure roll 20 cooperates with the fuser roll 10 to form a nip at a contact point between the elastomer surface of the outer layer 5 of the fuser roll 10 and the pressure roll 20 through which copy paper or other substrates (not shown) pass such that toner images are formed on the paper. The pressure roll 20 has a rigid steel core 2 with a polymer or elastomer surface or layer 3 thereon.

A supply wick 30 contains a polymeric release agent, or fuser oil, 26 that may be a solid or liquid at room temperature, but it is a fluid at operating temperatures. The pressure roll 20 may also include a heating element (not shown).

In the device shown in FIG. 5, the supply wick 30 supplies the polymeric release agent or oil 26 to the surface of the meter roll 27 thereby coating the meter roll 27 with the release agent or oil 26. A donor roll 28 is in press contact with the meter roll 27 to transport the release agent or oil 26 to the elastomer surface 5 of the fuser roll 10. The meter roll 27 and the donor roll 28 are rotatably mounted in the directions indicated by the arrows. A metering, or doctor blade 29 is provided to regulate an amount of release agent or oil 26 coating the meter roll 27. The doctor blade 29 regulates the amount of release agent or oil 26 by controlling a thickness layer of the release agent or oil 26 that is initially applied to the meter roll 27 and ultimately to the elastomer surface 5.

Multiple smoothing/camouflaging devices, such as brushes 50 are disposed in contact with a surface of each of the meter roll 27, the donor roll 28 and the fuser roll 10. In an exemplary embodiment, the brushes 50 are comprised of a high temperature fiber-like material with a low nap surface that would smooth/camouflage any imperfections in the coverage of the release agent or oil 26 that is on each of the meter roll 27, the donor roll 28 and the fuser roll 10. Additionally, the brushes 50 could reduce and/or remove the amount of debris on each of the meter roll 27, the donor roll 28 and the fuser roll 10 that may be entrapped in the release agent or oil 26.

In an exemplary embodiment, the brushes 50 are a consumable item that would be replaced during maintenance of fusing system and/or the image forming apparatus. In the embodiment, an assembly (not shown) holds the brush 50 in contact with the fuser roll and/or oscillates perpendicular to the rotation of the fuser roll 10 (see FIG. 3*b*). The brush 50 is in contact with the fuser roll 10 so that the surface of the brush 50 can smooth/camouflage the fuser oil or agent without removing an appreciable amount from the fuser roll 10. Additional brushes may be placed in contact with the donor roll 28 and/or the metering roll 27. The additional brushes 50 of the assembly may be a permanent part of the fusing system or may be replaceable along with the brush 50 that contacts the fuser roll 10.

In an exemplary embodiment, one or more of the brushes 50 oscillates to ensure the entire surface of the respective meter roll 27, donor roll 28 and fuser roll 10 is contacted by the respective brush 50 thereby smoothing/camouflaging a non-uniform application of the release agent or oil 26 due to imperfections in the doctor blade 29 and/or debris entrapped in the release agent or oil 26. In an embodiment, an amount of travel for a typical oscillation would be, but is not restricted to, an order of 2 to 10 mm with a fixed or variable rate of rotation.

Although FIGS. 4 and 5 show rollers and brushes disposed at each of the meter roll 27, the donor roll, 28 and the fuser roll 29, in various exemplary embodiments of the subject matter of this application, any combination of an amount of rollers 40 and brushes 50 may be used in any combination of placement locations. For example, one or more rollers 40 and/or brushes 50 may contact any one or more of the meter roll 27, the donor roll, 28 and the fuser roll 29.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An image formation apparatus, comprising:

a fuser roll/belt in pressure contact with a pressure roll/belt having a nip formed therebetween;

a meter roll that receives a release agent on a surface of the meter roll;

a donor roll in press contact with the meter roll disposed between the meter roll and the fuser roll/belt to transport the release agent from the meter roll to the fuser roll/belt;

a metering blade disposed adjacent the meter roll that regulates an amount of release agent on the surface of the meter roll by controlling a thickness layer of the release agent on the surface of the meter roll; and a smoothing/camouflaging device in contact with a surface of at least one of the fuser roll/belt, meter roll and donor roll, that smoothes/camouflages a non-uniform application of the release agent; wherein the smoothing/camouflaging device oscillates to ensure an entire surface of the at least one of the fuser roll/belt, meter roll and donor roll is contacted by the smoothing/camouflaging device.

2. The image formation apparatus of claim 1, wherein the smoothing/camouflaging device is comprised of a high temperature fibrous material with a low nap surface.

3. The image formation apparatus of claim 1, wherein the smoothing/camouflaging device is a roller comprised of a high temperature fibrous material with a low nap surface.

4. The image formation apparatus of claim 1, wherein the smoothing/camouflaging device is a brush comprised of a high temperature fibrous material with a low nap surface.

5. The image formation apparatus of claim 1, wherein the smoothing/camouflaging device oscillates at about an order of 2 to 10 mm with a fixed or variable rate of rotation.

6. The image formation apparatus of claim 3, wherein the roller oscillates to ensure an entire surface of the at least one of the fuser roll/belt, meter roll and donor roll is contacted by the smoothing/camouflaging device.

7. The image formation apparatus of claim 4, wherein the brush oscillates to ensure an entire surface of the at least one of the fuser roll/belt, meter roll and donor roll is contacted by the smoothing/camouflaging device.

8. The image formation apparatus of claim 1, wherein the smoothing/camouflaging device reduces defects in a printed image resulting from the non-uniform distribution of the release agent on components of the image formation apparatus.

9. A method of reducing imperfections in a printed image caused by non-uniform distribution of a release agent, comprising:

applying a release agent to a surface of a meter roll;

regulating an amount of release agent on the surface of the meter roll with a metering blade;

conveying the release agent to a fuser roll/belt via a donor roll;

smoothing/camouflaging a non-uniform distribution of the release agent by contacting at least one of the meter roll, donor roll, and fuser roll/belt with a smoothing/camouflaging device; and oscillating the smoothing/camouflaging device over a surface of the at least one of the meter roll, donor roll, and fuser roll/belt to ensure an entire surface of the at least one of the fuser roll/belt, meter roll and donor roll is contacted by the smoothing/camouflaging device.

10. The method of reducing imperfections caused by non-uniform distribution of a release agent of claim 9, further comprising:

providing a roller having a high temperature fibrous material with a low nap surface for smoothing/camouflaging the non-uniform distribution of the release agent.

11. The method of reducing imperfections caused by non-uniform distribution of a release agent of claim 9, further comprising:

providing a brush having a high temperature fibrous material with a low nap surface for smoothing/camouflaging the non-uniform distribution of the release agent.

12. The method of reducing imperfections caused by non-uniform distribution of a release agent of claim 10, further comprising:

oscillating the roller over a surface of the at least one of the meter roll, donor roll, and fuser roll/belt to ensure an entire surface of the at least one of the fuser roll/belt, meter roll and donor roll is contacted by the smoothing/camouflaging device.

13. The method of reducing imperfections caused by non-uniform distribution of a release agent of claim 11, further comprising:

oscillating the brush over a surface of the at least one of the meter roll, donor roll, and fuser roll/belt to ensure an entire surface of the at least one of the fuser roll/belt, meter roll and donor roll is contacted by the smoothing/camouflaging device.

14. The method of reducing imperfections caused by non-uniform distribution of a release agent of claim 9, wherein the smoothing/camouflaging device oscillates at about an order of 2 to 10 mm with a fixed or variable rate of rotation.

15. The method of reducing imperfections caused by non-uniform distribution of a release agent of claim 12, wherein the roller oscillates at about an order of 2 to 10 mm with a fixed or variable rate of rotation.

16. The method of reducing imperfections caused by non-uniform distribution of a release agent of claim 13, wherein the brush oscillates at about an order of 2 to 10 mm with a fixed or variable rate of rotation.

17. A method of reducing imperfections in a printed image caused by non-uniform distribution of a release agent in an image formation apparatus, comprising:

a fuser roll/belt in press contact with a pressure roll having a nip formed therebetween;

a meter roll that receives a release agent on a surface of the meter roll;

a donor roll in press contact with the meter roll disposed between the meter roll and the fuser roll to transport the release agent from the meter roll to the fuser roll;

a metering blade disposed adjacent the meter roll that regulates an amount of release agent on the surface of the meter roll by controlling a thickness layer of the release agent on the surface of the meter roll; and a smoothing/camouflaging device in contact with a surface of at least one of the fuser roll/belt, meter roll and donor roll, that smoothes/camouflages a non-uniform application of the release agent, wherein reducing imperfections includes:

applying the release agent to the surface of the meter roll;

regulating an amount of the release agent on the surface of the meter roll with the metering blade;

conveying the release agent to the fuser roll via the donor roll;

smoothing/camouflaging the non-uniform distribution of the release agent by contacting the at least one of the meter roll, donor roll, and fuser roll/belt with the smoothing/camouflaging device; wherein the smoothing/camouflaging device oscillates to ensure an entire surface of the at least one of the fuser roll/belt, meter roll and donor roll is contacted by the smoothing/camouflaging device.

18. The image formation apparatus of claim 1, wherein the image formation apparatus is a xerographic system.

* * * * *